United States Patent [19]

Mineck

[11] 3,994,998

[45] Nov. 30, 1976

[54] CARBURETOR WITH SELF ADJUSTING VENTURI

[76] Inventor: Fred Mineck, 16225 N. Cave Creek, Space 11, Phoenix, Ariz. 85032

[22] Filed: July 7, 1975

[21] Appl. No.: 593,720

[52] U.S. Cl. ..... 261/50 A; 261/52; 261/121 A

[51] Int. Cl.[2] ..... F02M 7/22; F02M 1/02

[58] Field of Search ..... 261/50 A, 52, 121 A

[56] References Cited

UNITED STATES PATENTS

| | | | |
|---|---|---|---|
| 2,718,388 | 9/1955 | McCurdy | 261/50 A |
| 3,210,055 | 10/1965 | Kingsley | 261/44 R |
| 3,432,152 | 3/1969 | Sweeney | 261/50 A |
| 3,528,787 | 9/1970 | Hallberg | 261/44 R |
| 3,592,449 | 8/1968 | Elgohary | 261/44 R |

FOREIGN PATENTS OR APPLICATIONS

| | | | |
|---|---|---|---|
| 435,768 | 1935 | United Kingdom | 261/50 A |

*Primary Examiner*—Tim R. Miles
*Assistant Examiner*—Gregory N. Clements
*Attorney, Agent, or Firm*—Warren F. B. Lindsley

[57] ABSTRACT

An improved carburetor for an internal combustion engine, the carburetor being simplified in construction over the prior art carburetors and incorporating versatility through the use of a self-adjusting venturi which permits the carburetor to operate effectively over a wide range of operating conditions.

13 Claims, 7 Drawing Figures

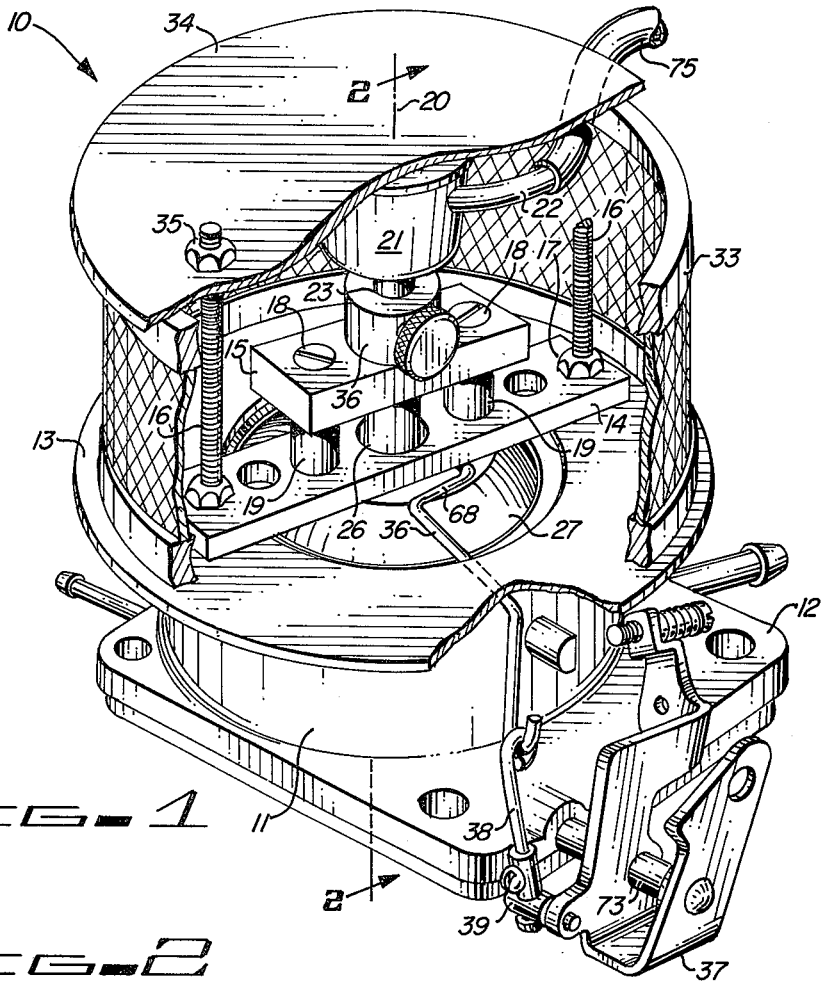
FIG. 1
FIG. 2
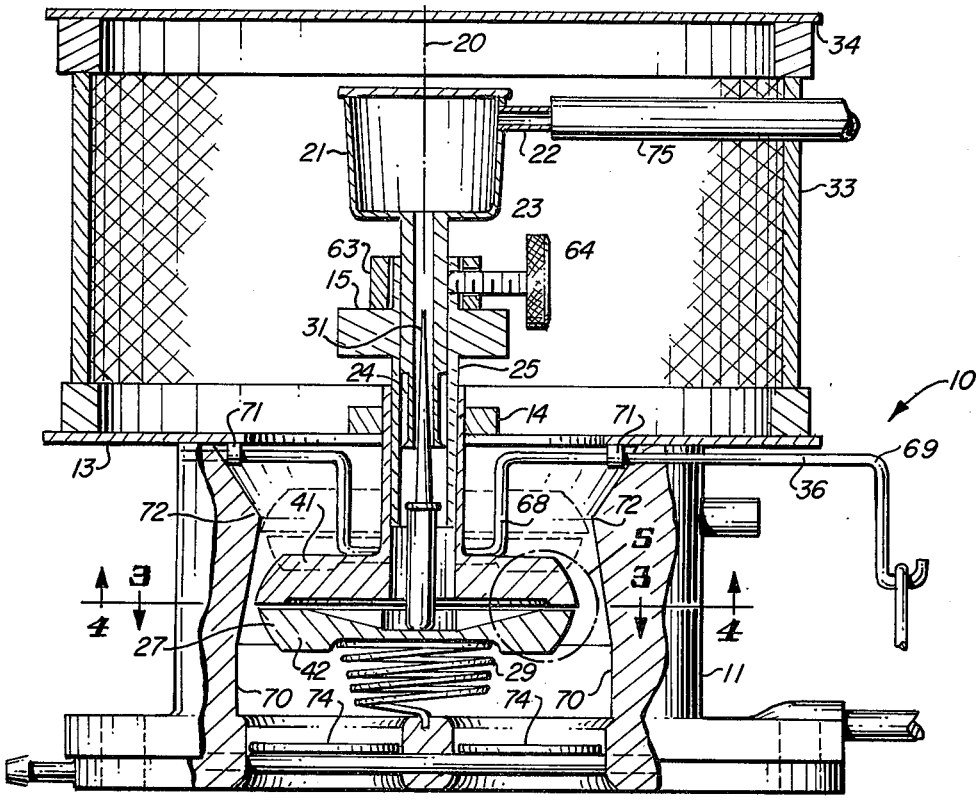

CARBURETOR WITH SELF ADJUSTING VENTURI

BACKGROUND OF THE INVENTION

One of the most important parts of an internal combustion engine is its carburetor. Unless the carburetor performs well the engine will not start reliably, will not run smoothly and deliver adequate power and good gasoline mileage, and will produce excessive atmospheric pollutants.

Because the proper operation of the carburetion system is so essential to total engine performance, much attention has been given in the past to carburetor design and over the years the carburetor has become a complex device.

The complexity of the modern carburetor is apparent when it is recognized that the typical carburetor system employs six separate systems i.e. a float system for controlling the level of fuel in the bowl; a low speed or idling system to provide an adequate fuel supply when air intake is low; a high speed or cruising system utilizing the venturi; an accelerating pump system to overcome fuel inertia during a sudden increase in power demand; a power system to provide adequate fuel under conditions of reduced vacuum resulting from the opening of the throttle; and a choke system for increasing the fuel-to-air ratio under starting or low temperature conditions.

In addition there are anti-percolation vents, hot idle compensators, anti-dieseling solenoids, deceleration controls in most modern carburetors.

This multitude of special systems and features requires careful adjustment and maintenance and the many small ducts and valves are vulnerable to blockage and wear by dust and dirt finding their way through the air filter.

Furthermore, until recently there has been a greater emphasis on certain aspects of performance such as starting, acceleration and power developed with insufficient emphasis given to gasoline mileage and atmospheric polluting conditions.

Thus, a need exists for a new approach to carburetor design which will produce a better balance in total performance while utilizing a simpler design that does not require the numerous separate systems and special accessories and which provides in particular improved gas mileage and a lower level of atmospheric pollution.

SUMMARY OF THE INVENTION

In accordance with the invention claimed, an improved and greatly simplified carburetor is provided which utilizes a completely different approach to meet the full range of operating requirements.

It is therefore one object of this invention to provide an improved carburetor for an internal combustion engine.

Another object of this invention is to provide an improved carburetor which is much simpler in construction and operation than the known carburetors utilized in modern automobiles.

A further object of this invention is to provide an improved carburetor in which the number of moving parts is drastically reduced.

A still further object of this invention is to provide an improved carburetor in which the several separate systems of the known carburetors are virtually reduced to a single system which functions properly over a wide range of operating conditions.

A still further object of this invention is to provide in such a carburetor a means for sealing off the fuel supply when the engine stops running, thereby eliminating evaporation and the associated atmospheric pollution.

A still further object of this invention is to incorporate in the design of the carburetor a self-adjusting venturi which insures a high speed air stream for fuel and air mixing at all engine speeds.

A still further object of this invention is to eliminate the known float and needle valve assembly and thereby dispose of the ill effects of acceleration forces on curves or sudden stops.

A still further object of this invention is to provide a new and improved carburetor which eliminates the need for accelerating pumps, idle jets, automatic chokes, anti-percolation vents, anti-dieseling solenoids and the like.

A still further object of this invention is to provide an improved carburetor with effective fuel and air mixing capabilities yielding more finely divided fuel droplets than heretofore possible thoroughly dispersed in the air stream accomplished through the provision of an enlarged venturi area which is automatically controlled for optimum performance at all engine speeds.

A still further object of this invention is to provide an 18 to 1 air-to-fuel ratio compared with typical values for conventional carburetors of 15 to 1, the higher ratio being tolerated by more efficient mixing action resulting in improved fuel economy and reduced atmospheric pollution without destructive effects on the engine.

A still further object of this invention is to provide a carburetor in which all fuel mixing is accomplished ahead of the throttle plate, thereby realizing a more uniform distribution of fuel throughout the air body.

A still further object of this invention is to provide an improved inexpensive carburetor which can be economically disposed of at the end of its useful life as opposed to making costly repairs to prolong its life.

Yet another object of this invention is to provide such a carburetor which utilizes only a single needle valve with sufficient movement to insure moving of any small foreign particles thereby eliminating or greatly reducing blockage or restriction of the fuel passage.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 1 is a perspective view of an improved carburetor embodying the invention with part of the housing broken away to reveal its structural details;

FIG. 2 is a sectional view of the carburetor viewed along line 2—2 of FIG. 1;

DESCRIPTION OF THE PREFERRED EMBODIMENT

Figure 3:
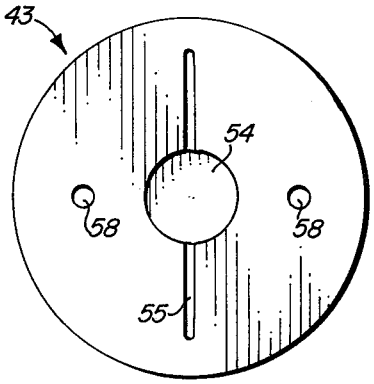
FIG. 3 is a sectional view of a part of the carburetor taken along line 3—3 of FIG. 2.

Referring more particularly to the drawing by characters of reference, FIGS. 1–7 disclose an improved carburetor 10 comprising a cylindrical carburetor body 11 rigidly secured between a conventional throttle plate 12 at one end and an opencentered disc-shaped air filter plate 13 at its other end. First and second fuel system support brackets 14 and 15 are provided each in the form of a flat rectangular strap. The first bracket 14 lies flat across the filter support plate 13 and is secured thereto by bolts 16 and nuts 17. The second bracket 15 is mounted above and parallel to the first bracket by means of a pair of screws 18 and tubular spacers 19, the spacers 19 being disposed vertically between brackets 14 and 15 with one arranged near each end of bracket 15. Screws 18 pass through clearance holes in the upper bracket 15, the open centers of spacers 19 being threaded into tapped holes in bracket 14. A cup-shaped fuel well 21 having a fuel intake tube 22 extending thereinto from one side and a fuel delivery tube 23 extending vertically downward from the center of its circular underside is symmetrically disposed about the vertical center-line 20 of the carburetor. The delivery tube 23 is provided with a reduced outer diameter along its lower half 24 with an air bleeder tube 25 symmetrically disposed thereabout and rigidly secured inside a center hole of the upper bracket 15. The delivery tube also extends through a central clearance hole 26 in the lower bracket 14. A piston assembly 27 employing a vertical cylindrical upper extension 28 is supported above throttle plate 12 by a coil spring 29 and is stabilized vertically by the air bleeder tube 25 which is surrounded by extension 28. A tapered metering needle 31 is mounted within the carburetor with its pointed end extending upwardly inside the lower end of fuel delivery tube 23 and its enlarged bullet-shaped lower end 32 extending into a central cavity inside piston assembly 27. A conventional cylindrical air filter 33 is supported on top of plate 13 and secured thereto by means of a top cover plate 34, two nuts 35 (one of which is shown) and the upper extensions of bolts 16. An enriching crank 36 is coupled to the throttle arm 37 by a lever 38 and pivot coupler 39.

Figure 5:
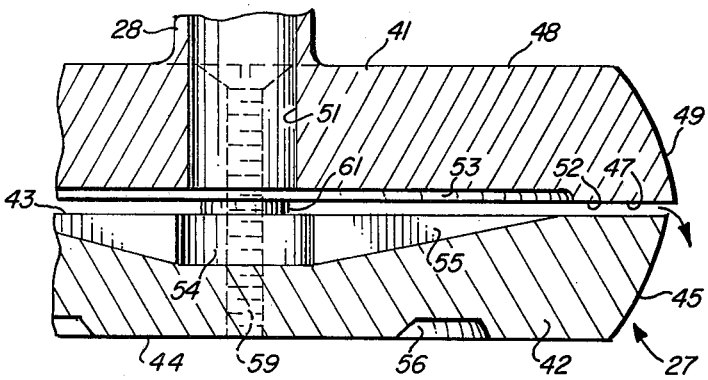
FIG. 5 is an enlarged partial sectional view of the piston assembly shown in the area 5 of FIG. 2.
Figure 4:
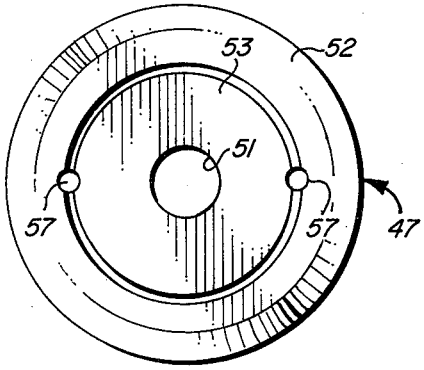
FIG. 4 is a sectional view of a part of the carburetor taken along line 4—4 of FIG. 2.

The piston assembly 27 has only its top surface exposed in FIG. 1 and is more clearly shown in FIGS. 2 and 5 with clarification of individual parts illustrated in FIGS. 3 and 4. As shown in FIGS. 2–5 piston assembly 27 comprises an upper piston section 41 and a lower piston section 42.

Lower piston section 42 is in the general form of a section of a sphere with its upper surface 43 having a diameter somewhat greater than that of its lower surface 44 and its circumferential outer surface 45 tapering outwardly and upwardly from the periphery of lower surface 44 to the periphery of its upper surface 43.

The upper piston section 41 resembling the lower section 42 but is inverted in relation thereto so that its lower surface 47 has a diameter somewhat greater than the diameter of its upper surface 48. The circumferential outer surface 49 of piston section 42 tapers downwardly and outwardly form the periphery of surface 48 to the periphery of surface 47. In addition, the upper piston section 41 is integral with the vertical cylindrical collar or extension 28. Extension 28 extends perpendicularly upwardly from the center of surface 48 with its hollow cylindrical inner opening 51 extending all the way down through piston section 41. The lower surface 47 is divided into outer and inner plane surfaces 52 and 53. Outer surface 52 is bounded on the inside by the periphery of inner surface 53 and inner surface 53 is provided with a circular depression in surface 47. As shown in FIG. 4, inner opening 51 of extension 28 pierces the center of inner surface 53.

The upper surface 43 of lower piston section 42 is flat except for a circular center hole or opening 54 and a tapered slot 55 extending from a point inside of the periphery of surface 43 inwardly of piston section 42 toward the base of opening 54 as shown in FIG. 5. The center hole 54 extends approximately half way through the thickness of piston section 42. As noted slot 55 extends from hole 54 outwardly thereof an equal distance on each side terminating just below the outer edge of inner surface 53 of piston section 41. At the point of its intersection with center hole 54, slot 55 has a depth equal to the depth of hole 54 and from this point its depth decreases linearly to zero at the outer extremity of the slot.

The lower surface 44 of section 42 is flat except for an annular depression 56 which serves as a cradle for the upper end of spring 29.

The upper and lower piston sections 41 and 42 are secured together in their relative positions shown in FIGS. 2 and 5 by screws 59 passing through holes 57 of upper section 41 and threading into holes 58 in lower section 42. An image of one of these screws 59 is shown in FIG. 5. The upper surface 43 of section 42 is spaced away from the lower surface 52 of section 42 is spaced away from the lower surface 52 of section 41 by means of two washers 61 interposed between surfaces 43 and 52 through which the screws 59 passes. One of the washers 61 is shown in FIG. 5.

As shown in FIGS. 2 and 5, the lower surface 47 of piston section 41 has a slightly greater diameter than the upper surface 43 of section 42.

When sections 41 and 42 are assembled as shown in FIG. 5 a passage is formed which leads downwardly through opening 51 into the space between surfaces 43 and 47 which is augmented by the depression of surface 53, hole 54 and slot 55 with the passage extending radially outwardly from the center of the piston assembly 27 to the peripheries of surfaces 43 and 47.

Figure 6:
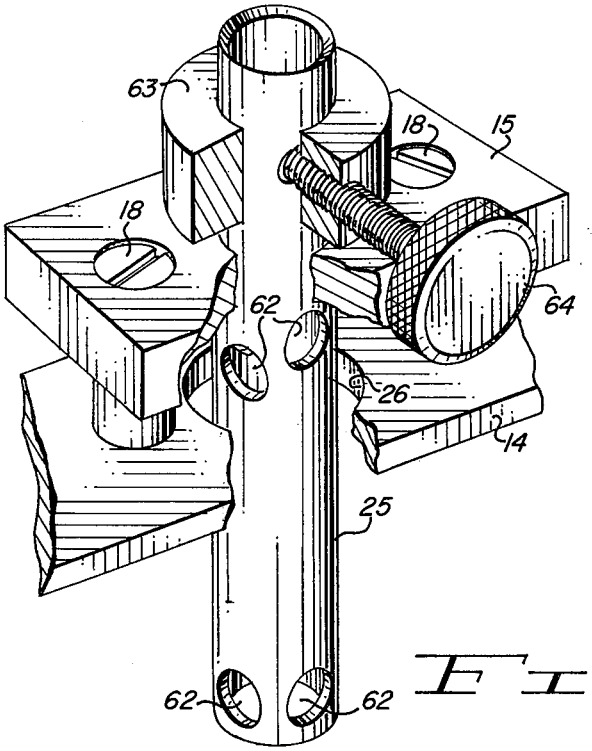
FIG. 6 is an enlarged perspective view of a central part of the carburetor including an air bleeder tube.

FIGS. 1, 2, 6 and 7 illustrate details of the structure and assembly involving air bleeder tube 25, fuel well 21, metering needle 31 and piston section 41. Bleeder tube 25, as shown in FIG. 6, with its several distributed air holes 62 is held in place by an interference fit or by brazing or welding within a central hole in bracket 15. Bracket 15 is rigidly supported above bracket 14 by means of spacers 19 and screws 18 with bracket 14 secured to the carburetor body 11. Bleeder tube 25 is thus rigidly supported relative to the carburetor body 11. As indicated most clearly in FIGS. 6 and 7, tube 25 serves as a support member for mounting fuel well 21. Fuel delivery tube 23 is inserted into the upper end of bleeder tube 25 fitting relatively snugly therein and is fixedly secured at an adjustable height by means of a collar 63 which encircles the upper end of tube 25. Collar 63 carries a set screw 64 threaded into collar 63 which passes through a clearance hole in tube 25 and bears against the outer surface of tube 23. The broken line image of fuel well 21 indicated the range over which its position may be adjusted.

Figure 7:
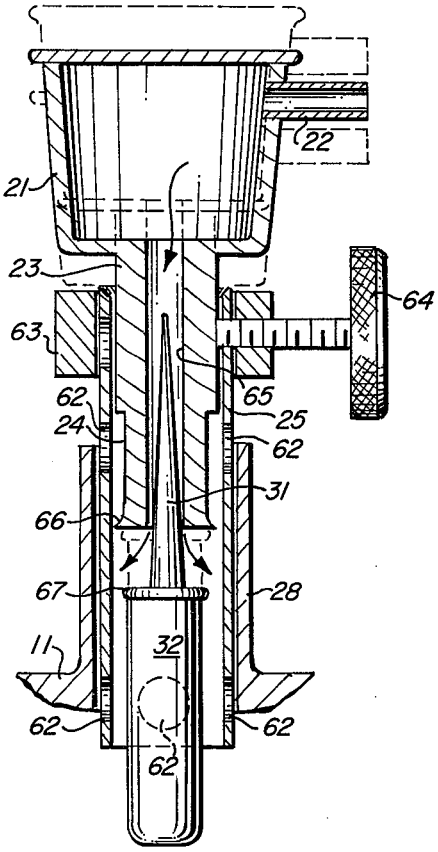
FIG. 7 is a sectional view of the fuel metering portion of the carburetor.

FIG. 7 illustrates the upper extension 28 of piston section 41 surrounding bleeder tube 25 with tube 25 serving as a guide for piston assembly 27 as it moves vertically in response to vacuum and the restraining force of spring 29.

Metering needle 31 extending upwardly into the hollow central bore 65 of fuel delivery tube 23 has its lower end 32 resting on the lower surface of hole 54 in piston section 42. Thus, as piston assembly 27 moves upwardly, the tapered needle 31 tends increasingly to restrict the flow of fuel through bore 65. In the absence of gas pressure in the fuel line spring 29 drives piston assembly 27 upwardly to a position at which the top surface of the enlarged bullet-shaped lower end 32 of metering needle 31 bears against the flared lower end 66 of tube 23. A neopreme O-ring 67 surrounding needle 31 forms a seal between the flat upper extremity of end 32 of the metering needle 31 and the flared lower end of the tube 23 in the uppermost position of piston assembly 27.

The enriching crank 36 is fashioned from a steel wire formed to provide a central U-shaped portion 68 and a crank handle portion 69. The handle 69 is disposed perpendicularly to the plane of the U-shaped portion 68. Crank 36 is pivotally mounted in notches at opposite sides of the top of body 11 being secured therein by plate 13 and its lateral or horizontal motion being limited by two retainer rings 71 which are rigidly secured in place on the crank just inside body 11.

The inside wall 70 of the cylindrical carburetor body 11 is formed in the shape of a venturi with its minimum diameter at its projection 72 located approximately on a level just above the outermost projection of piston section 41 when piston assembly 27 is in its uppermost position. The walls flare outwardly below projection 72 so that as piston assembly 27 moves downwardly the clearance increases between the outer edge of piston assembly 27 and walls 70.

OPERATION

Before the engine employing this carburetor is started, the piston assembly 27 is held in the fully upward position by spring 29 so that needle 31 is inserted all the way up into tube 23 and O-ring 67 seals the lower end of tube 23 preventing any flow of fuel into the carburetor from fuel well 21.

As the engine is started and the gas peddle or lever is moved throttle arm 37 pivots on its axis 73 to open the throttle butterfly valves 74 and simultaneously through the action of lever 38 and coupler 39 causes enriching crank 36 to pivot forcing U-shaped deviation 68 to move downward against the top surface 48 of piston section 41. This action causes piston assembly 27 to move downwardly. As assembly 27 moves downwardly metering needle 31 moves with it, opening a passage for fuel to flow from tube 23 downwardly around needle 31 emerging from tube 23 just below its flared lower end 66. At this point the fuel mixes with air which has entered bleeder tube 25 through holes 62 above the lowered upper end of extention 28. The flared end 66 of needle 31 forms with the inner surface of tube 25 a venturi configuration which produces the high air speed and low pressure essential to efficient vaporization and mixing of fuel from tube 23 with air flowing by. The air flow is induced, of course by the pumping action of the engine as it is turned over by its starter.

The air and fuel mixture flows downwardly from tube 25 as shown in the drawings through the passage inside piston assembly 27 emerging at its outer edge where it mixes again with a second supply of air which has passed downward from inside filter 33 over the top surface of piston section 41, between the outer edge of piston section 41 and inside wall 70 meeting the air and fuel mixture at the outer edge of surface 47 at the minimum cross-section of the venturi where ideal conditions for vaporization and mixing occurs. This final fuel and air mixture then flows downwardly through the throttle plate and valves 74 into the engine manifold.

Once the engine starts, the air flow through the carburetor increases greatly and as the air flow around piston assembly 27 increases, a correspondingly increased force is exerted thereon which is developed partly by vacuum created below assembly 27 and partly by pressure differentials in the venturi. After starting and for all idling and running conditions the piston assembly is moved downwardly sufficiently so that the enriching crank is no longer in control.

A key feature of this invention is that as the demand for more fuel increases with an increased throttle opening, the increased air flow automatically and simultaneously compels the downward movement of a single part, i.e. assembly 27, thereby increasing the supply of fuel and increasing the dimensions of the large venturi as appropriate to accommodate the increased demand and supply of air. Similarly, as the throttle is closed and the air demand and supply decreases, the piston assembly 27 moves upward, thereby reducing the supply of fuel and simultaneously reducing the dimensions of the large venturi, which dimensional reduction produces an advantageous increase in air speed through the venturi to prevent any reduction in carburetor efficiency which would otherwise result from the reduced air flow.

Fuel is supplied to fuel well 21 at constant pressure from a fuel line 75 through tube 22. An electric fuel pump is ideally suited for this purpose.

The judicious design and proper balance between the dimensions, proportions and contours of the air bleeder tube 25, fuel delivery tube 23, needle 31, piston assembly 27, carburetor body 11 and especially its inside walls 70, and the spring 29 results in an improved carburetor which operates efficiently and effectively under all operating conditions including starting, idling cruising, accelerating and heavy loads. Such versatile performance is achieved primarily as a result of the automatically self-adjusting large venturi configuration formed between piston assembly 27 and the walls 70 of body 11.

The entire carburetor assembly utilizes only four moving parts comprising metering needle 31, piston assembly 27, enriching crank 36 and spring 29. The only adjustment required is the vertical position of the fuel well 21 which controls the setting of the metering needle 31.

Field tests have demonstrated that gasoline mileage is approximately doubled when compared with the performance of a conventional carburetor on the same engine. An air-fuel ratio of 18 to 1 is achieved and tolerated without difficulty.

A significantly improved carburetor is thus disclosed in accordance with the stated objects of the invention. Although but a single embodiment has been illustrated and described it will be apparent to those skilled in the art that various changes and modifications may be made therein without departing from the spirit of the invention or from the scope of the appended claims.

What is claimed is:

1. A carburetor comprising:

a hollow mixing chamber provided with a fuel inlet means at one end and a fuel outlet means at the other end, the interior of said hollow chamber forming a venturi shaped opening tapering from a minimum diameter at a point along its length toward a larger diameter opening at one end of said chamber, a piston movably mounted in said opening for movement longitudinal thereof, whereby movement of said piston within said opening forms a variable first venturi section between its outer periphery and the inside surface of said opening, a needle valve engaged at one of its ends with said piston for movement by said piston within said fuel inlet means, said piston comprising a hollow cylindrical extension in which one end of said fuel inlet means extends, said needle valve being movable within said extension, biasing means attached to said carburetor and engaging said piston for biasing said piston toward said needle valve into said fuel inlet means, said needle valve controlling the flow of fuel through said fuel inlet means to said opening and around at least a part of said piston, a first air inlet means connected to said one end of said chamber, said first air inlet means providing a passageway into said chamber for air drawn thereinto for mixing with the fuel from said fuel inlet means during movement of the fuel over the outer periphery of said piston and through said first venturi section into said fuel outlet means, an apertured tube mounted along the length of said fuel inlet means and extending within said extension and around said needle valve, at least a part of the apertures of said tube being in communication with said first air inlet means, the air entering through the apertures in said tube flowing along the outer periphery of said fuel inlet means and drawn into the fuel emitted from said fuel inlet means, the air drawn into the carburetor for mixing with the fuel from said fuel inlet means during the movement of the fuel over the outer periphery of said piston and through said venturi section and into said fuel outlet means occurs through the effects of a negative pressure applied to said fuel outlet means.

2. The carburetor set forth in claim 1 wherein:

said needle valve is provided with means for sealing the fuel inlet means from the hollow interior of said opening when the fluid pressure in said fuel outlet means is at a given value.

3. The carburetor set forth in claim 1 wherein:

said needle valve is tapered along its length so as to form a second venturi section within said fuel inlet means.

4. The carburetor set forth in claim 1 wherein:

said biasing means comprises a spring which biases said piston along said opening in said chamber in accordance with the fuel demands of an associated engine connected to said fuel outlet means, whereby the effects of said first venturi section and the atmospheric pressure of the air entering said air inlet means overcomes the biasing effect of said spring means when said fuel outlet means is open.

5. The carburetor set forth in claim 1 in further combination with:

lever means connected to the carburetor for biasing said piston against the force of said biasing means during initial starting efforts of an associated engine.

6. The carburetor set forth in claim 1 in further combination with:

a second air inlet means connecting atmospheric air to said fuel inlet means at a point adjacent said needle valve.

7. The carburetor set forth in claim 1 wherein:

said piston is provided with an opening, the interior of which is penetrated by said needle valve when said piston engages said needle valve under the influence of said biasing means.

8. The carburetor set forth in claim 7 wherein:

said piston comprises a pair of sectors axially aligned and separated from each other to provide a passageway laterally between the juxtapositioned sectors, said chamber comprises a hollow cylindrical extension in which one end of said fuel inlet means extends, said needle valve being movable within said extension, and said opening in said piston extends through one sector and into the other.

9. The carburetor set forth in claim 1 wherein:

said fuel inlet means, needle valve and biasing means are in axial alignment.

10. The carburetor set forth in claim 1 wherein:

said needle valve comprises a rod tapering from a larger diameter size toward a smaller size along at least a part of its length from a point adjacent its piston engaging end for increasing the fuel inlet discharge capacity under increasing fuel demands.

11. The carburetor set forth in claim 1 wherein:

said needle valve is separate from said piston and capable of movement independently of said piston.

12. The carburetor set forth in claim 1 wherein:

said piston comprises along at least a part of its length a segment of a sphere.

13. The carburetor set forth in claim 1 in further combination with:

adjustment means for varying the relative position of said fuel inlet means and said apertured tube for controlling the fuel air mixture of the carburetor.

* * * * *